US009410508B2

(12) United States Patent
Ide et al.

(10) Patent No.: US 9,410,508 B2
(45) Date of Patent: Aug. 9, 2016

(54) CONTROLLING APPARATUS FOR AN ENGINE

(71) Applicant: MITSUBISHI JIDOSHA KOGYO KABUSHIKI KAISHA, Tokyo (JP)

(72) Inventors: Hideto Ide, Tokyo (JP); Katsunori Ueda, Tokyo (JP); Toshiyuki Miyata, Tokyo (JP)

(73) Assignee: MITSUBISHI JIDOSHA KOGYO KABUSHIKI KAISHA, Tokyo (JP)

( * ) Notice: Subject to any disclaimer, the term of this patent is extended or adjusted under 35 U.S.C. 154(b) by 315 days.

(21) Appl. No.: 14/069,437

(22) Filed: Nov. 1, 2013

(65) Prior Publication Data

US 2014/0123962 A1 May 8, 2014

(30) Foreign Application Priority Data

Nov. 2, 2012 (JP) ..... 2012-242880

(51) Int. Cl.
*F02M 25/08* (2006.01)
*F02D 41/00* (2006.01)

(52) U.S. Cl.
CPC ..... *F02M 25/0836* (2013.01); *F02D 41/004* (2013.01); *F02M 25/089* (2013.01)

(58) Field of Classification Search
CPC .. F02M 25/0836; F02M 25/08; F02M 25/089
USPC ..... 123/516–520
See application file for complete search history.

(56) References Cited

U.S. PATENT DOCUMENTS

2002/0174856 A1* 11/2002 Tagami ..... F02D 41/0032 123/520
2012/0222657 A1* 9/2012 Sano ..... F02M 25/089 123/520

FOREIGN PATENT DOCUMENTS

| | | | |
|---|---|---|---|
| JP | 2000-45886 | A | 2/2000 |
| JP | 2005-139955 | A | 6/2005 |
| JP | 2007-192182 | A | 8/2007 |
| JP | 2007-218250 | A | 8/2007 |

* cited by examiner

*Primary Examiner* — Stephen K Cronin
*Assistant Examiner* — Xiao Mo
(74) *Attorney, Agent, or Firm* — Birch, Stewart, Kolasch & Birch, LLP

(57) ABSTRACT

A controlling apparatus for an engine includes a purge path connected to a sealing-type fuel tank and an intake system of an engine and is configured to allow purge gas containing evaporated fuel from the fuel tank to flow therethrough. A purge valve placed in the purge path is configured to adjust a flow rate of the purge gas. A calculation unit calculates a degree of opening of the purge valve based on a target introduction ratio of the purge gas, and a controlling unit controls the purge valve so as to establish the degree of opening calculated by the calculation unit. The calculation unit corrects, in high-pressure purge performed when a pressure in the fuel tank increases exceeding a predetermined pressure, the degree of opening using a tank pressure flow velocity correction coefficient K2 corresponding to an upstream pressure of the purge valve.

9 Claims, 6 Drawing Sheets

ENGINE OPERATING

ENGINE STOPPING

FILLING OIL

CONTROLLING APPARATUS FOR AN ENGINE

CROSS-REFERENCE TO THE RELATED APPLICATION

This application incorporates by references the subject matter of Application No. 2012-242880 filed in Japan on Nov. 2, 2012 on which a priority claim is based under 35 U.S.C. S119(a).

FIELD

The present invention relates to a controlling apparatus for an engine for introducing purge gas containing evaporated fuel from a sealing-type fuel tank into an intake system.

BACKGROUND

Conventionally, a technology for introducing fuel gas (evaporated fuel) evaporated in a fuel tank of a vehicle into a cylinder of an engine to prevent leakage of fuel components to the outside of the vehicle is known. Evaporated fuel in the fuel tank is temporarily recovered by a canister, and purge gas containing the evaporated fuel desorbed from the canister is introduced into an intake path. A purge valve for adjusting the flow rate of the purge gas is placed on a purge path for connecting the canister and the intake path, and the degree of opening of the purge valve is controlled in response to an operation state of the engine.

For example, in Patent Document 1 (Japanese Patent Laid-Open No. 2000-45886), a method for purging evaporated fuel absorbed to absorbent in the canister to an intake path of an engine is disclosed. In the technology, the evaporated fuel absorbed to the absorbent is vaporized by introducing a negative pressure of the intake path into the canister in a closed state with respect to the atmosphere, and the evaporated fuel vaporized in the canister is purged to the intake system by a difference between the pressure in the canister stepped up by the vaporization and the pressure in the intake path. The flow rate of the evaporated fuel purged to the intake path is grasped based on the magnitude of the pressure difference between the canister and the intake path and the magnitude of the absolute pressure in the canister.

It is to be noted that, in Patent Document 1, the canister is placed between the fuel tank in a sealed state and the intake path, and a vacuum control valve is placed between the fuel tank and the canister. The vacuum control valve is opened when the pressure in the fuel tank becomes higher than a predetermined pressure. Consequently, the evaporated fuel in the fuel tank is recovered by the canister, and the pressure in the fuel tank drops. Such purge of the evaporated fuel performed for the object of reduction of the pressure in the fuel tank as described above is referred to as high-pressure purge, reduced pressure purge or the like.

However, in the method disclosed in Patent Document 1 described above, it is necessary to acquire in advance a relationship between the magnitude of the pressure difference between the canister and the intake path and the flow rate of evaporated fuel to be purged in response to the magnitude of the absolute pressure in the canister. Further, it is necessary to store all of the acquired data in an electronic controlling apparatus. In addition, complicated working for acquiring all data is additionally performed. As a result, it is necessary to provide a ROM having a great capacity in the electronic controlling apparatus and there is the possibility that the cost may increase.

Further, in the high-pressure purge performed when the pressure in the fuel tank is high, the pressure on the upstream side of a valve for purge (purge valve) such as vacuum control valve as that in Patent Document 1 becomes higher than the atmospheric pressure. Therefore, where the degree of opening of the purge valve is controlled similarly as upon normal purge in which evaporated fuel recovered by the canister is purged, there is a high possibility that the flow rate of the purge gas may increase from an intended introduction ratio of purge gas.

That is, in the high-pressure purge, it is difficult to obtain an intended flow rate of purge gas, and there is the possibility that a rich air-fuel mixture may be introduced in the cylinder of the engine. Further, in such a case as just described, there is a concern that the control may be complicated in that the control for adjusting the amount of fuel to be injected from an injector is required separately and so forth. Accordingly, it is desired to introduce, also in the high-pressure purge, purge gas into the intake system with an intended introduction ratio of purge gas without complicated control.

SUMMARY

Technical Problems

The present technology disclosed herein has been worked out in view of such subjects as described above, and it is an object of the present technology to provide a controlling apparatus for an engine that can secure an appropriate flow rage of purge gas in high-pressure purge by a simple configuration.

It is to be noted that, in addition to the object just described, it can be positioned as another object of the present technology to achieve a working-effect that is derived from configurations indicated by an embodiment of the present invention hereinafter described but cannot be achieved by the known technologies.

Solution to Problems (1) The controlling apparatus for an engine disclosed herein includes a purge path connected to a sealing-type fuel tank and an intake system of an engine and configured to allow purge gas containing evaporated fuel from the fuel tank to flow therethrough and a purge valve placed in the purge path and configured to adjust a flow rate of the purge gas. The controlling apparatus for an engine further includes a calculation unit that calculates a degree of opening of the purge valve based on a target introduction ratio of the purge gas, and a controlling unit that controls the purge valve so as to establish the degree of opening calculated by the calculation unit. The calculation unit corrects, in high-pressure purge performed when a pressure in the fuel tank increases exceeding a predetermined pressure, the degree of opening at least using a tank pressure flow velocity correction coefficient corresponding to an upstream pressure of the purge valve.

(2) Preferably, the calculation unit corrects, in the high-pressure purge, the degree of opening using a flow velocity ratio correction coefficient corresponding to a ratio between a flow velocity of intake air that passes a throttle valve of the intake system and a flow velocity of the purge gas that passes the purge valve.

(3) Preferably, the calculation unit corrects, in the high-pressure purge, the degree of opening using a pipe resistance flow velocity correction coefficient taking a ventilation resistance until the purge gas is introduced into the intake system into consideration.

(4) Preferably, the controlling apparatus for an engine further includes a correction coefficient map set such that the tank pressure flow velocity correction coefficient has a proportional relationship to the upstream pressure of the purge valve. At this time, preferably the calculation unit applies the upstream pressure to the correction coefficient map to acquire the tank pressure flow velocity correction coefficient.

Advantageous Effects

With the controlling apparatus for an engine disclosed herein, when the degree of opening of the purge valve is calculated based on the target introduction ratio of purge gas, in the high-pressure purge, the degree of opening is corrected at least using the tank pressure flow velocity correction coefficient corresponding to the upstream pressure of the purge valve. Therefore, an appropriate flow rate of purge gas can be secured by the simple configuration. Further, since complicated calculation is not required, the capacity of the ROM can be reduced.

BRIEF DESCRIPTION OF THE DRAWINGS

The nature of this invention, as well as other objects and advantages thereof, will be explained in the following with reference to the accompanying drawings, in which like reference characters designate the same or similar parts throughout the figures and wherein.

DESCRIPTION OF EMBODIMENTS

In the following, an embodiment is described with reference to the drawings. It is to be noted that the embodiment hereinafter described is merely illustrative to the end and there is no intention to eliminate various modifications and applications of the technology not explicitly specified in the embodiment described below.

[1. Apparatus Configuration]

Figure 1:
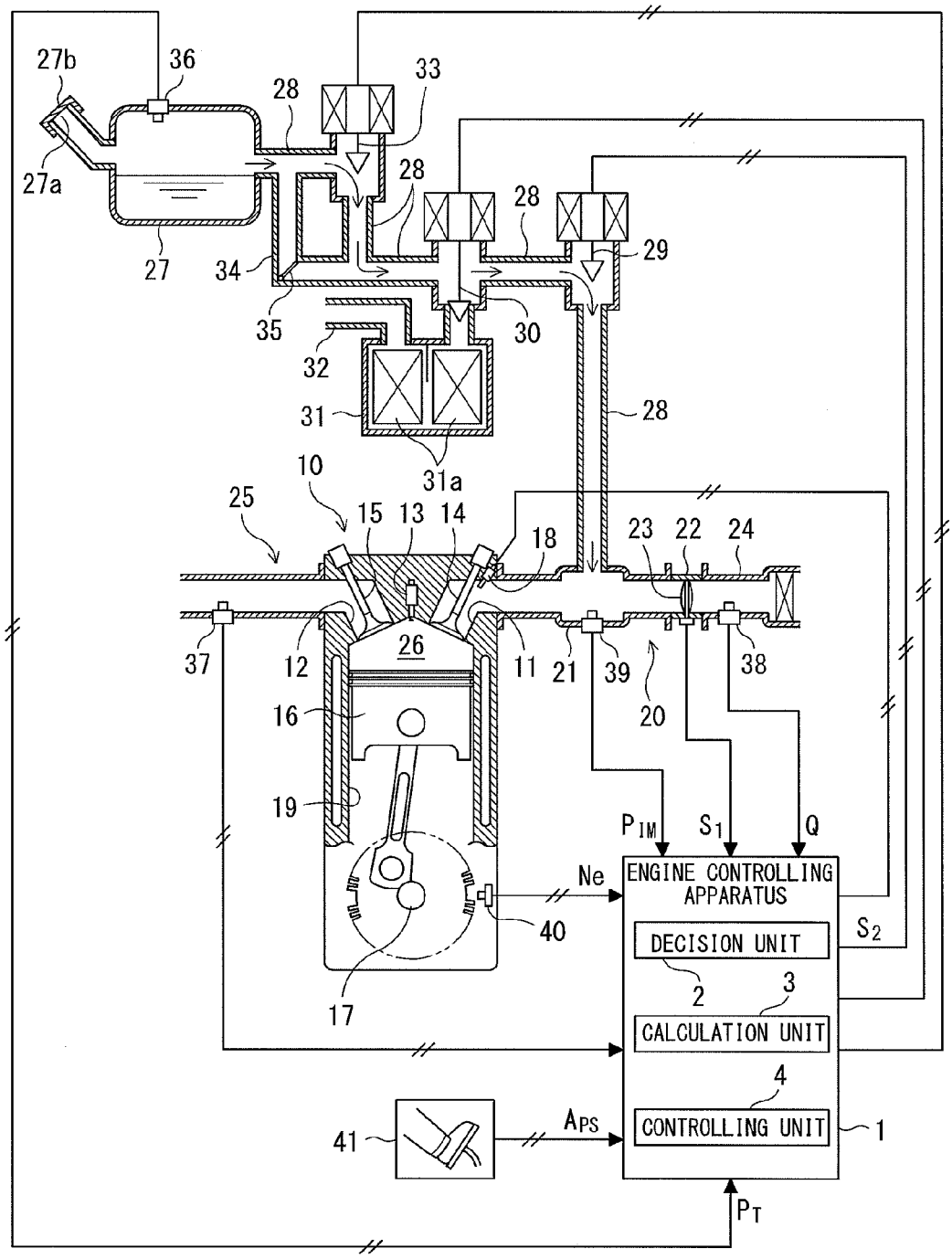
FIG. 1 is a view exemplifying a block configuration of a controlling apparatus for an engine according to an embodiment and a configuration of an engine to which the controlling apparatus is applied and depicting the configurations in a high pressure state of a fuel tank.

A controlling apparatus for an engine of the present embodiment is applied to a vehicle-carried gasoline engine 10 depicted in FIG. 1. Here, one of a plurality of cylinders provided in the engine 10 of the multi-cylinder type is described. A piston 16 is fitted for back and forth sliding movement along an inner peripheral face of a cylinder 19 formed in a hollow cylindrical shape. A space surrounded by an upper face of the piston 16 and the inner peripheral face and a top face of the cylinder 19 functions as a combustion chamber 26 of the engine 10. The piston 16 is connected to a crankshaft 17 through a connecting rod.

An intake port 11 for supplying intake air into the combustion chamber 26 therethrough and an exhaust port 12 for exhausting exhaust air after burning in the combustion chamber 26 therethrough are bored on the top face of the cylinder 19. Further, an intake valve 14 and an exhaust valve 15 are provided at an end portion of the intake port 11 and the exhaust port 12 on the combustion chamber 26 side, respectively. Further, an ignition plug 13 is provided on the top end of the cylinder 19 in a state in which a tip end thereof projects to the combustion chamber 26 side. An ignition timing by the ignition plug 13 is controlled by the engine controlling apparatus 1 hereinafter described.

An injector 18 for injecting fuel is provided in the intake port 11. The amount of fuel to be injected from the injector 18 is controlled by the engine controlling apparatus 1 hereinafter described. Further, an intake manifold 20 is provided on the upstream side of the intake flow with respect to the injector 18. A surge tank 21 for temporarily storing air to flow to the intake port 11 side is provided at an upstream portion of the intake manifold 20. A portion of the intake manifold 20 on the downstream side with respect to the surge tank 21 is formed so as to branch toward the intake ports 11 of the cylinders 19, and the surge tank 21 is positioned at the branching point. The surge tank 21 functions so as to relax intake pulsation or intake interference that may possibly occur in each cylinder 19.

A throttle body 22 is connected to the upstream side of the intake manifold 20. An electronically-controlled throttle valve 23 is built in the throttle body 22 so that the amount of air to flow to the intake manifold 20 side is adjusted in response to the degree of opening (throttle opening degree) of the throttle valve 23. The throttle opening degree is controlled by the engine controlling apparatus 1. An intake path 24 is connected to the upstream side of the throttle body 22, and an air filter is placed on the upstream side of the intake path 24. Consequently, fresh air filtered by the air filter is supplied to the cylinders 19 of the engine 10 through the intake path 24 and the intake manifold 20.

A purge path 28 for introducing purge gas containing evaporated fuel vaporized in the fuel tank 27 into the intake system of the engine 10 is connected to the surge tank 21. The fuel tank 27 is a sealing-type tank and assumes a closed state with respect to the atmosphere in a state in which a cap 27*b* is fitted with an oil filling entrance 27*a*. When fuel is to be supplied into the fuel tank 27, the cap 27*b* is removed and a nozzle of an oil filling machine 50 [refer to FIG. 5(*c*)] is inserted into the oil filling entrance 27*a*.

A tank pressure sensor 36 for detecting the pressure (tank pressure) $P_T$ in the fuel tank 27 is provided on the fuel tank 27. The tank pressure $P_T$ detected by the tank pressure sensor 36 is transmitted to the engine controlling apparatus 1. Further, a switch not shown is provided on the cap 27*b*, and a state of the cap 27*b* (whether or not the cap 27*b* is fitted) is detected by the switch and a result of the detection is transmitted to the engine controlling apparatus 1. It is to be noted that the state of the cap 27*b* may be decided otherwise using information detected, for example, by a stroke sensor provided on a filler door not shown.

An electromagnetic purge valve 29 for controlling the flow rate (hereinafter referred to as purge gas flow rate Qp) of the purge gas to be introduced into the surge tank 21 is placed on the purge path 28. The purge gas flow rate Qp increases as the opening degree of the purge valve 29 is controlled so as to increase. The purge gas flow rate Qp decreases as the opening degree is controlled so as to decrease. When the opening degree is zero, the purge gas flow rate Qp is zero (in other words, the purge gas is not introduced into the intake system).

Further, an electromagnetic bypass valve 30 is placed on the purge path 28 between the fuel tank 27 and the purge valve 29. A canister 31 for temporarily recovering the evaporated fuel is connected to the bypass valve 30. If the bypass valve 30 is opened, then the purge path 28 and the canister 31 are placed into a communicated state with each other, but, if the bypass valve 30 is closed, then the canister 31 is placed into an isolated state from the purge path 28.

An atmospheric air path 32 for taking in external fresh air is connected to the canister 31 and the canister 31 is placed in an opened state with respect to the atmosphere. Activated carbon 31*a* for sorbing the evaporated fuel is built in the canister 31. Here, the canister 31 is dedicated for oil-filling for temporarily recovering the evaporated fuel generated in the fuel tank 27 when the fuel is supplied into the fuel tank 27 (hereinafter referred to as upon filling oil). It is to be noted that the evaporated fuel recovered by the canister 31 is not desorbed from the activated carbon 31*a* when the pressure thereof is close to the atmospheric pressure $P_A$ but is desorbed when a negative pressure higher than a predefined value is introduced into the canister 31.

An electromagnetic sealed valve 33 is placed on the purge path 28 between the fuel tank 27 and the bypass valve 30. Further, a bypass path 34 for bypassing the sealed valve 33 is connected to the purge path 28 between the fuel tank 27 and the bypass valve 30, and a relief valve 35 is placed on the bypass path 34. The relief valve 35 is a safety valve for a case in which opening and closing control of the sealed valve 33 is disabled by some cause. The relief valve 35 is automatically opened when the tank pressure $P_T$ of the fuel tank 27 rises excessively high, but is normally placed in a closed state when the sealed valve 33 is in a normal state.

If the sealed valve 33 is opened, then the fuel tank 27 and the purge path 28 up to the bypass valve 30 are placed into a communicated state with each other. If the sealed valve 33 is closed, then the fuel tank 27 is isolated, in a sealed state thereof, from the purge path 28 on the intake system side with respect to the sealed valve 33. Here, all of the purge valve 29, bypass valve 30 and sealed valve 33 are needle valves and are used so that fine adjustment of the purge gas flow rate Qp can be performed. The opening degree of the purge valve 29, bypass valve 30 and sealed valve 33 is controlled by the engine controlling apparatus 1.

An exhaust manifold 25 is provided on the downstream side of the exhaust port 12. The exhaust manifold 25 is formed in a shape for merging exhaust air from the cylinders 19 and is connected on the downstream side thereof to an exhaust path, an exhaust catalyst apparatus or the like not shown. An air fuel ratio sensor 37 for grasping air fuel ratio information (A/F) of mixture air burned in the combustion chamber 26 is provided on the exhaust path on the downstream side with respect to the exhaust manifold 25. The air fuel ratio sensor 37 is, for example, an $O_2$ sensor, an LAFS (linear air fuel ratio sensor) or the like.

An air flow sensor 38 for detecting an intake flow rate Q is provided in the intake path 24. The intake flow rate Q is a parameter corresponding to a flow rate (throttle flow rate Qth) of air (intake air) passing the throttle valve 23. An intake manifold pressure sensor 39 for detecting the pressure (intake manifold pressure) $P_{IM}$ in the intake manifold 20 is provided on the surge tank 21. An engine rotation speed sensor 40 for detecting the rotational angle of the crankshaft 17 to acquire a rotational speed Ne of the engine 10 is provided for the crankshaft 17.

Further, an accelerator position sensor 41 for detecting the operation amount (accelerator operation amount $A_{PS}$) of an accelerator pedal is provided on the vehicle. The accelerator operation amount $A_{ps}$ is a parameter corresponding to an acceleration request or a starting intention of a driver, and, in other words, the accelerator operation amount $A_{PS}$ correlates to the load to the engine 10 (output request to the engine 10). The air fuel ratio information, intake flow rate Q, intake manifold pressure $P_{IM}$, engine rotation speed Ne and accelerator operation amount $A_{PS}$ acquired by the sensors 37 to 41 are transmitted to the engine controlling apparatus 1.

The engine controlling apparatus 1 (Engine Electronic Control Unit) is provided on the vehicle in which the engine 10 is equipped. The engine controlling apparatus 1 is a computer including a CPU for executing various calculation processes, a ROM in which a program and data necessary for the control of the CPU are stored, a RAM in which a result of calculation by the CPU or the like is temporarily stored, input and output ports for inputting and outputting a signal to and from the outside therethrough, and so forth. The engine controlling apparatus 1 is an electronic controller for totally controlling various systems including an ignition system, a fuel system, an intake and exhausting system and a valve gear system for the engine 10.

To the input side of the engine controlling apparatus 1, the tank pressure sensor 36, air fuel ratio sensor 37, air flow sensor 38, intake manifold pressure sensor 39, engine rotation speed sensor 40 and accelerator position sensor 41 are connected. On the other hand, to the output side of the engine controlling apparatus 1, the injector 18, throttle valve 23, purge valve 29, bypass valve 30 and sealed valve 33 are connected. As a particular controlling target by the engine controlling apparatus 1, the amount of fuel to be injected from the injector 18, the injection time period, the ignition time period by the ignition plug 13 and the degree of opening of the throttle valve 23, purge valve 29, bypass valve 30 and sealed valve 33 are applied.

It is to be noted that, in the engine controlling apparatus 1, an opening degree controlling unit (not shown) for calculating a target degree of opening of the throttle valve 23 and outputting a controlling signal to the throttle valve 23 so that an actual opening degree of the valve coincides with the target opening degree is provided. The target opening degree is calculated, for example, based on the accelerator operation amount $A_{PS}$ detected by the accelerator position sensor 41. Here, the target opening degree of the throttle valve 23 calculated by the opening degree controlling unit corresponds to the current opening degree $S_1$ of the throttle valve 23. In other words, the opening degree $S_1$ of the throttle valve 23 that is a controlling value is used as a detection value for control by the engine controlling apparatus 1. It is to be noted that, in place of such a configuration as described above, a configuration may be applied in which a throttle position sensor for detecting the throttle opening degree $S_1$ is provided and a sensor value thereof is used for control.

Further, in the engine controlling apparatus 1, a target purge ratio acquisition unit (not shown) for acquiring a target purge ratio $R_{TGT}$ corresponding to a target introduction ratio of purge gas is provided. In the present embodiment, the ratio of the flow rate Qp of purge gas that passes the purge valve 29 to the flow rate Q of intake air that passes the throttle valve 23

(namely, the throttle flow rate Qth) is defined as purge ratio R. In particular, the purge ratio R is defined by the following expression (1):

$$R=Qp/Qth \quad (1)$$

The target purge ratio $R_{TGT}$ is acquired, for example, based on the air fuel ratio information detected by the air fuel ratio sensor 37, the intake flow rate Q detected by the air flow sensor 38 and so forth. The target purge ratio $R_{TGT}$ acquired by the target purge ratio acquisition unit is transmitted to a calculation unit 3 in the engine controlling apparatus 1 hereinafter described.

[2. Controlling Configuration]

[2-1. Outline of Control]

In the engine controlling apparatus 1, the opening degree control of the purge valve 29, bypass valve 30 and sealed valve 33 placed on the purge path 28 is performed. Since the purge valve 29 is disposed at a position nearest to the intake system, fine adjustment of the purge gas flow rate Qp can be performed by controlling the opening degree $S_2$ of the purge valve 29. The opening degree $S_2$ of the purge valve 29 is calculated by the calculation unit 3 hereinafter described. It is to be noted that the opening degree here corresponds to the magnitude of a flow path sectional area at a position (referred to as valve location) at which the valve is provided. For example, when the opening degree of the valve is zero (in a closed state of the valve), the flow path sectional area at the valve location is zero. Meanwhile, when the opening degree of the valve is not zero (in an open state of the valve), the magnitude of the flow path sectional area of the valve location increases as the opening degree increases. Accordingly, the opening degree of the valve can be calculated from the flow path sectional area at the valve location.

On the other hand, the bypass valve 30 and the sealed valve 33 are controlled to a state in which the opening degree thereof is zero (in a closed state of the valves) or to a fully open state (an open state of the valves) depending upon whether the engine 10 is operating or stopping or oil is being filled or else the fuel tank 27 is in a high-pressure state. In short, the opening degree of the bypass valve 30 and the opening degree of the sealed valve 33 are not calculated here but are controlled to one of the fully closed state and the fully open state.

The engine controlling apparatus 1 controls the opening degree of the purge valve 29, bypass valve 30 and sealed valve 33 depending upon whether the engine 10 is operating or stopping or oil is being filled or else the fuel tank 27 is in a high-pressure state. When the engine 10 is operating, control is performed so that the evaporated fuel recovered by the canister 31 is desorbed and the purge gas containing the evaporated fuel is introduced into the surge tank 21. The control is hereinafter referred to as normal purge control.

When the engine 10 is stopping or oil is being filled, control is performed so that the introduction of the purge gas is cut off. The control is hereinafter referred to as purge cut control. Further, when the fuel tank 27 is in a high-pressure state, control is performed so that the purge gas containing the evaporated fuel evaporated in the fuel tank 27 is introduced into the surge tank 21. The control is hereinafter referred to as high-pressure purge control. The engine controlling apparatus 1 is characterized in the high-pressure purge control.

[2-2. Controlling Block Configuration]

In order to perform the control described above, the engine controlling apparatus 1 includes functional elements as a decision unit 2, a calculation unit 3 and a controlling unit 4. The elements mentioned may be implemented by electronic circuitry (hardware) or may be programed as software. Or else, some of the functions may be provided as hardware while the remaining one or ones of the functions are implemented by software.

The decision unit 2 decides which one of the normal purge control, purge cut control and high-pressure purge control is to be performed. The decision unit 2 decides which one of the following conditions (A) to (D) is satisfied from the engine rotation speed Ne detected by the engine rotation speed sensor 40, tank pressure $P_T$ detected by the tank pressure sensor 36 and state of the cap 37*b* of the oil filling entrance 37*a:*

(A) that the engine rotation speed Ne is not zero ($Ne \neq 0$) and the tank pressure $P_T$ is lower than a predetermined pressure $P_0$ ($P_T < P_0$);

(B) that the engine rotation speed Ne is zero ($Ne=0$) and the tank pressure $P_T$ is lower than the predetermined pressure $P_0$ ($P_T < P_0$) and besides the cap 27*b* is in a fitted state;

(C) that the cap 27*b* is in a removed state; and (D) that the tank pressure $P_T$ is equal to or higher than the predetermined pressure $P_0$ ($P_T \geq P_0$).

The decision unit 2 decides, when the condition (A) is satisfied, that the engine 10 is operating but decides, when the condition (B) is satisfied, that the engine 10 is stopping. Further, the decision unit 2 decides, when the condition (C) is satisfied, that oil is being filled but decides, when the condition (D) is satisfied, that the fuel tank 27 is in a high-pressure state. It is to be noted that the predetermined pressure $P_0$ is set in advance to a lower value than that of a permissible pressure of the fuel tank 27.

When it is decided by the decision unit 2 that the engine 10 is operating and when it is decided that the fuel tank 27 is in a high-pressure state, the result of the decision is transmitted to the calculation unit 3 and the controlling unit 4. On the other hand, when it is decided by the decision unit 2 that the engine 10 is stopping and when it is decided that oil is being filled, the result of the decision is transmitted to the controlling unit 4.

The calculation unit 3 calculates, in the normal purge control, the flow path sectional area $A_2$ (hereinafter referred to as purge area $A_2$) at location of the purge valve 29 corresponding to the opening degree $S_2$ of the purge valve 29 based on the target purge ratio $R_{TGT}$. If a result of the decision that the engine 10 is operating is transmitted from the decision unit 2, then the calculation unit 3 calculates the purge area $A_2$ of the purge valve 29 for performing the normal purge control.

The purge ratio R is defined by the expression (1) given hereinabove. Here, since the throttle flow rate Qth and the purge gas flow rate Qp are represented by the following expressions (2) and (3), respectively, the purge ratio R is rewritten into the following expression (4):

$$Qth=Vth \times A_1 \quad (2)$$

$$Qp=Vp \times A_2=Vth \times A_2 \times K1 \quad (3)$$

$$R=(Vth \times A_2 \times K1)/(Vth \times A_1) \quad (4)$$

where $A_1$ is the flow path sectional area of the throttle valve 23 corresponding to the throttle opening degree $S_1$ and is hereinafter referred to as throttle area $A_1$. Further, Vth is the flow velocity of intake air that passes the throttle valve 23, and Vp is the flow velocity of purge gas that passes the purge valve 29, respectively. Further, K1 is the pipe resistance flow velocity correction coefficient for taking the ventilation resistance (pressure loss) until the purge gas is introduced into the surge tank 21 into account. Since the purge path 28 in which the purge gas flows is thinner than the path of the intake system (intake path 24 or intake manifold 20), the ventilation resistance of the purge path 28 is higher than that of the intake path in which intake air flows. Further, since the purge gas passes through the activated carbon 31*a* when it flows in the canister 31, the ventilation resistance increases further.

Where the ventilation resistance to the purge gas is ignored, since the pressure ratio across the throttle valve 23 and the pressure ratio across the purge valve 29 are equal to each other because the upstream pressure and the downstream pressure are equal to the atmospheric pressure $P_A$ and the intake manifold pressure $P_{IM}$, respectively, it is supposed that the flow velocity Vth of the intake air and the flow velocity Vp of the purge gas are equal to each other. However, actually since the ventilation resistance to the purge gas is high, the upstream pressure of the purge valve 29 is lower than the atmospheric pressure $P_A$. Therefore, the flow velocity Vp of the purge gas decreases and the purge gas flows but by a flow rate lower than the flow rate of the purge gas that is to flow originally.

Figure 2:
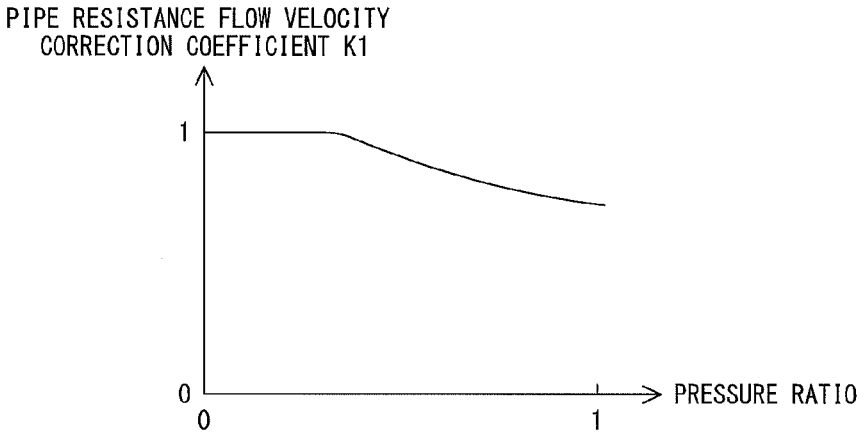
FIG. 2 is a pipe resistance flow velocity correction coefficient map depicting a relationship between a pressure ratio and a pipe resistance flow velocity correction coefficient K1.

Therefore, the pipe resistance flow velocity correction coefficient K1 is a correction coefficient used to increase, taking a pressure loss (decreasing amount of the purge gas flow rate) when the purge gas is introduced into the surge tank 21 into consideration, the purge area $A_2$ as much. The pipe resistance flow velocity correction coefficient K1 is acquired, for example, by storing such a pipe resistance flow velocity correction coefficient map as depicted in FIG. 2 in advance and applying a pressure ratio (intake manifold pressure $P_{IM}$/atmospheric pressure $P_A$) to the pipe resistance flow velocity correction coefficient map.

By multiplying the purge area $A_2$ by the pipe resistance flow velocity correction coefficient K1, it can be considered that the flow velocity Vth of the intake air and the flow velocity Vp of the purge gas are equal to each other. Accordingly, the purge area $A_2$ necessary for securing the target purge ratio $R_{TGT}$ is represented by the following expression (5):

$$A_2=A_1\times R_{TGT}/K1 \tag{5}$$

In short, in the normal purge control, the calculation unit 3 calculates the purge area $A_2$ by the expression (5) given above based on the throttle area $A_1$, target purge ratio $R_{TGT}$ and pipe resistance flow velocity correction coefficient K1. The purge area $A_2$ calculated by the calculation unit 3 is transmitted to the controlling unit 4.

The calculation unit 3 further calculates, in the high-pressure purge control, a high-pressure purge area $A_2'$ corresponding to the opening degree $S_2'$ of the purge valve 29 based on the target purge ratio $R_{TGT}$. If a result of the decision that the fuel tank 27 is in a high-pressure state is transmitted from the decision unit 2, then the calculation unit 3 calculates the high-pressure purge area $A_2'$ of the purge valve 29 used for performing the high-pressure purge control.

Figure 4:
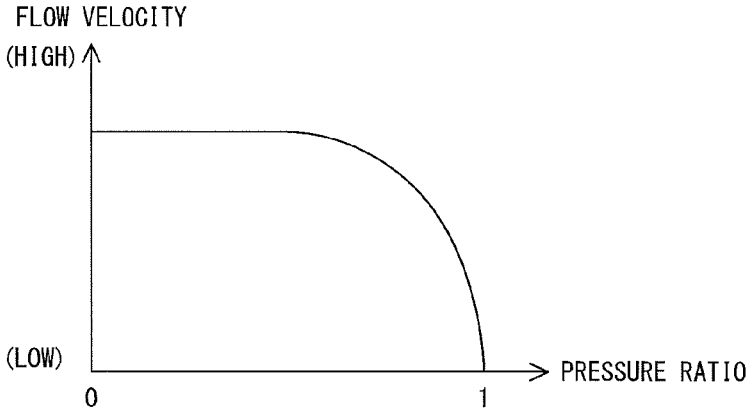
FIG. 4 is a flow velocity map depicting a relationship between a pressure ratio and a flow velocity.

While the purge ratio R is defined by the expression (1) given hereinabove and the throttle flow rate Qth and the purge gas flow rate Qp are represented by the expressions (2) and (3) given hereinabove, respectively, since the upstream pressure of the purge valve 29 in the high-pressure purge control is higher than the atmospheric pressure $P_A$, a high pressure is taken into consideration when the flow velocity Vp of the purge gas is calculated. Accordingly, the purge gas flow rate Qp' in the high-pressure purge is represented by the following expression (6):

$$Qp'=Vp(\text{taking high pressure into consideration})\times A_2'=(\text{flow velocity map } [P_{IM}/P_T]/K2\times K1)\times A_2' \tag{6}$$

where the flow velocity map $[P_{IM}/P_T]$ is the flow velocity Vp of purge gas acquired by applying the pressure ratio across the purge valve 29 (downstream pressure/upstream pressure) to the flow velocity map depicted in FIG. 4. The flow velocity map is stored in advance in the engine controlling apparatus 1. It is to be noted that, since the upstream pressure of the purge valve 29 in the high-pressure purge control can be considered as the tank pressure $P_T$ and the downstream pressure of the purge valve 29 is equal to the intake manifold pressure $P_{IM}$, the pressure ratio across the purge valve 29 is intake manifold pressure $P_{IM}$/tank pressure $P_T$.

Figure 3:
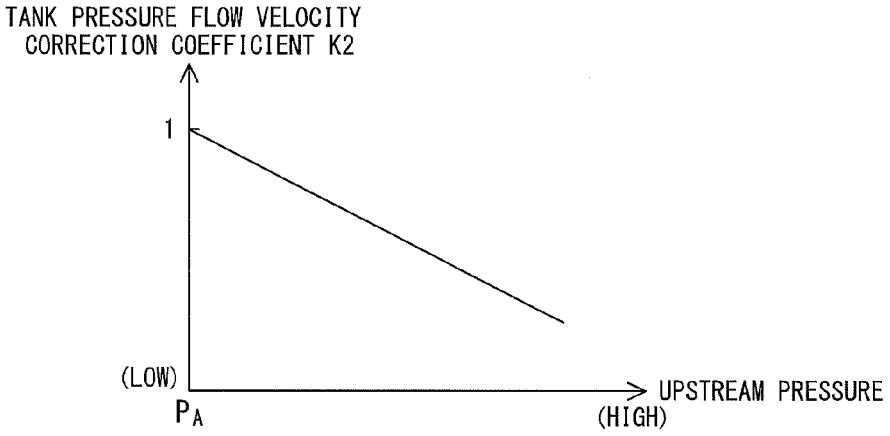
FIG. 3 is a tank pressure flow velocity correction coefficient map depicting a relationship between an upstream pressure and a tank pressure flow velocity correction coefficient K2.

Further, K2 is a correction coefficient corresponding to the upstream pressure of the purge valve 29 (hereinafter referred to as tank pressure flow velocity correction coefficient K2). The tank pressure flow velocity correction coefficient K2 is acquired, for example, from such a tank pressure flow velocity correction coefficient map as depicted in FIG. 3. The correction coefficient map is stored in advance in the engine controlling apparatus 1 and is set here such that the tank pressure flow velocity correction coefficient K2 has a proportional relationship to the upstream pressure of the purge valve 29. As depicted in FIG. 3, the tank pressure flow velocity correction coefficient K2 is set to 1 when the upstream pressure of the purge valve 29 is equal to the atmospheric pressure $P_A$ and is set such that it decreases linearly as the upstream pressure increases with respect to the atmospheric pressure $P_A$.

The flow rate Qp of the purge gas that passes the purge valve 29 varies if the upstream pressure varies with respect to the pressure ratio across the purge valve 29. In particular, even where the pressure ratio across the purge valve 29 is equal, the purge gas flow rate Qp increases as the upstream pressure becomes higher than the atmospheric pressure $P_A$. Therefore, in the high-pressure purge control in which the upstream pressure is equal to or higher than the atmospheric pressure $P_A$, the purge gas flow rate Qp' is acquired by dividing the purge gas flow velocity Vp in the high-pressure purge control acquired from the flow velocity map by the tank pressure flow velocity correction coefficient K2.

If the expressions (2) and (6) given hereinabove are substituted into the expression (1) and the resulting expression is solved for the high-pressure purge area $A_2'$, then the high-pressure purge area $A_2'$ is represented by the expression (7) given below. It is to be noted that, since the flow velocity Vth of intake air in the expression (2) is acquired by applying the pressure ratio across the throttle valve 23 (downstream pressure/upstream pressure) to the flow velocity map depicted in FIG. 4, in the expression (7), the flow velocity Vth of the intake air is represented as the flow velocity map $[P_{IM}/P_A]$:

$$A_2'=A_1\times R_{TGT}\times K2/K1\times(\text{flow velocity map } [P_{IM}/P_A]/\text{flow velocity map } [P_{IM}/P_T]) \tag{7}$$

If the ratio of the flow velocity Vth of intake air to the flow velocity Vp (taking a high pressure into consideration) of the purge gas in the expression (7) is placed as the coefficient (flow velocity ratio correction coefficient) K3, then the expression (7) can be rewritten into the following expression (8):

$$A_2'=A_1\times R_{TGT}\times K2/K1\times K3 \tag{8}$$

That is, in the high-pressure purge control, the calculation unit 3 calculates the high-pressure purge area $A_2'$ using the expression (8) given above based on the throttle area $A_1$, target purge ratio $R_{TGT}$, pipe resistance flow velocity correction coefficient K1, tank pressure flow velocity correction coefficient K2 and flow velocity ratio correction coefficient K3. It is to be noted that, by solving the expression (8) for the high-pressure purge area $A_2'$ in such a manner as described, then it can be considered that the tank pressure flow velocity correction coefficient K2 is a coefficient for correcting the high-pressure purge area $A_2'$ so as to be smaller than the purge area $A_2$ in the normal purge control. In other words, it can be considered that the tank pressure flow velocity correction coefficient K2 is a coefficient for correcting the purge gas flow rate Qp in a decreasing direction taking increase of the purge gas flow rate Qp arising from that the upstream pressure (namely, the tank pressure $P_T$) of the purge valve 29 has a high pressure into consideration.

It is to be noted that, if the purge area $A_2$ calculated in the normal purge control is used (namely, if it is replaced into the expression (5) given hereinabove), the expression (8) given hereinabove is represented as the following expression (9):

$$A_2' = A_2 \times K2 \times K3 \quad (9)$$

That is, it can be considered that the calculation unit 3 corrects the purge area $A_2$ calculated in the normal purge control using the tank pressure flow velocity correction coefficient K2 and the flow velocity ratio correction coefficient K3 to calculate the high-pressure purge area $A_2'$. The high-pressure purge area $A_2'$ calculated by the calculation unit 3 is transmitted to the controlling unit 4.

Figure 5A:
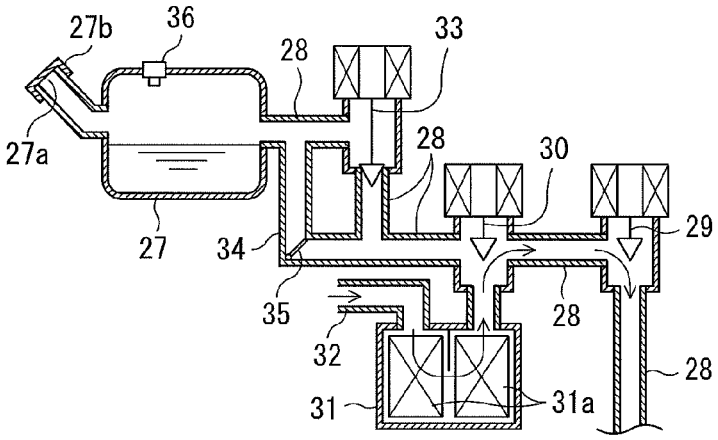
FIGS. 5(*a*) to 5(*c*) are views depicting a configuration extracted from the configuration of FIG. 1, wherein FIGS. 5(*a*), 5(*b*) and 5(*c*) depict a state of valves and a flow of gas during engine operating, during engine stopping and during filling of oil, respectively.
Figure 5B:
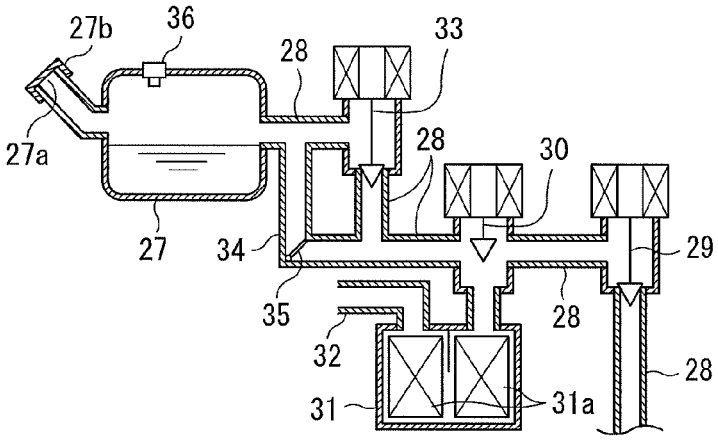
Figure 5C:
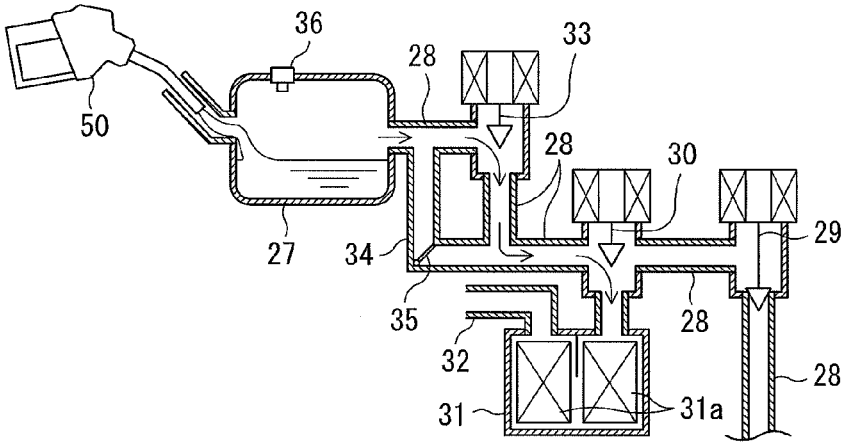

The controlling unit 4 performs opening degree control of the purge valve 29, bypass valve 30 and sealed valve 33 based on a result of the decision by the decision unit 2. If the result of the decision that the engine 10 is operating is transmitted from the decision unit 2, then the controlling unit 4 performs the normal purge control. In this case, the controlling unit 4 controls the purge valve 29 and the bypass valve 30 to an open state and controls the sealed valve 33 to a closed state as depicted in FIG. 5(*a*).

In particular, in the normal purge control, the fuel tank 27 is isolated by the sealed valve 33 and purge gas containing evaporated fuel recovered by the canister 31 is introduced suitably into the surge tank 21 of the intake manifold 20. Consequently, the capacity of the evaporated fuel capable of being recovered by the canister 31 is secured. At this time, the controlling unit 4 controls the opening degree $S_2$ of the purge valve 29 so as to correspond to the purge area $A_2$ calculated by the calculation unit 3. Consequently, purge gas corresponding to the target purge ratio $R_{TGT}$ is introduced into the intake system.

If the result of the decision that the engine 10 is stopping is transmitted from the decision unit 2, then the controlling unit 4 performs the purge cut control. In this case, as depicted in FIG. 5(*b*), the controlling unit 4 controls the opening degree $S_2$ of the purge valve 29 to zero to place the purge valve 29 into a closed state. It is to be noted that, in this case, the state of the bypass valve 30 and the sealed valve 33 where the engine 10 is operating is maintained, and the bypass valve 30 and the sealed valve 33 are placed into an open state and a closed state, respectively. In particular, if the result of the decision that the engine 10 is placed from an operating state into a stopping state is received, then the controlling unit 4 controls only the purge valve 29 into a closed state. It is to be noted that, if the engine 10 is placed into an operating state again, then the normal purge control is performed.

If the result of the decision that filling of oil is being performed is transmitted from the decision unit 2, then the controlling unit 4 performs the purge cut control for oil-filling. In this case, as depicted in FIG. 5(*c*), the controlling unit 4 controls the opening degree $S_2$ of the purge valve 29 to zero to place the purge valve 29 into a closed state. Further, the controlling unit 4 controls the bypass valve 30 and the sealed valve 33 into an open state. By placing the bypass valve 30 and the sealed valve 33 into the open state, the tank pressure $P_T$ decreases to a pressure with which oil filling can be performed and the evaporated fuel vaporized upon oil-filling is recovered by the canister 31 so that leakage of the evaporated fuel into the atmosphere is prevented. It is to be noted that, since the purge valve 29 is in a closed state at this time, the purge gas is not introduced into the intake system.

If the result of the decision that the fuel tank 27 is in a high-pressure state is transmitted from the decision unit 2, then the controlling unit 4 performs the high-pressure purge control. In this case, as depicted in FIG. 1, the controlling unit 4 controls the purge valve 29 and the sealed valve 33 into an open state and controls the bypass valve 30 into a closed state. In particular, in the high-pressure purge control, the canister 31 is isolated by the bypass valve 30 and purge gas containing the evaporated fuel accumulated in the fuel tank 27 is introduced into the surge tank 21. Consequently, the tank pressure $P_T$ in the fuel tank 27 is reduced. At this time, the controlling unit 4 controls the opening degree $S_2$ of the purge valve 29 so as to correspond to the high-pressure purge area $A_2'$ calculated by the calculation unit 3. Consequently, the purge gas corresponding to the target purge ratio $R_{TGT}$ is introduced into the intake system.

[3. Flow Chart]

Figure 6:
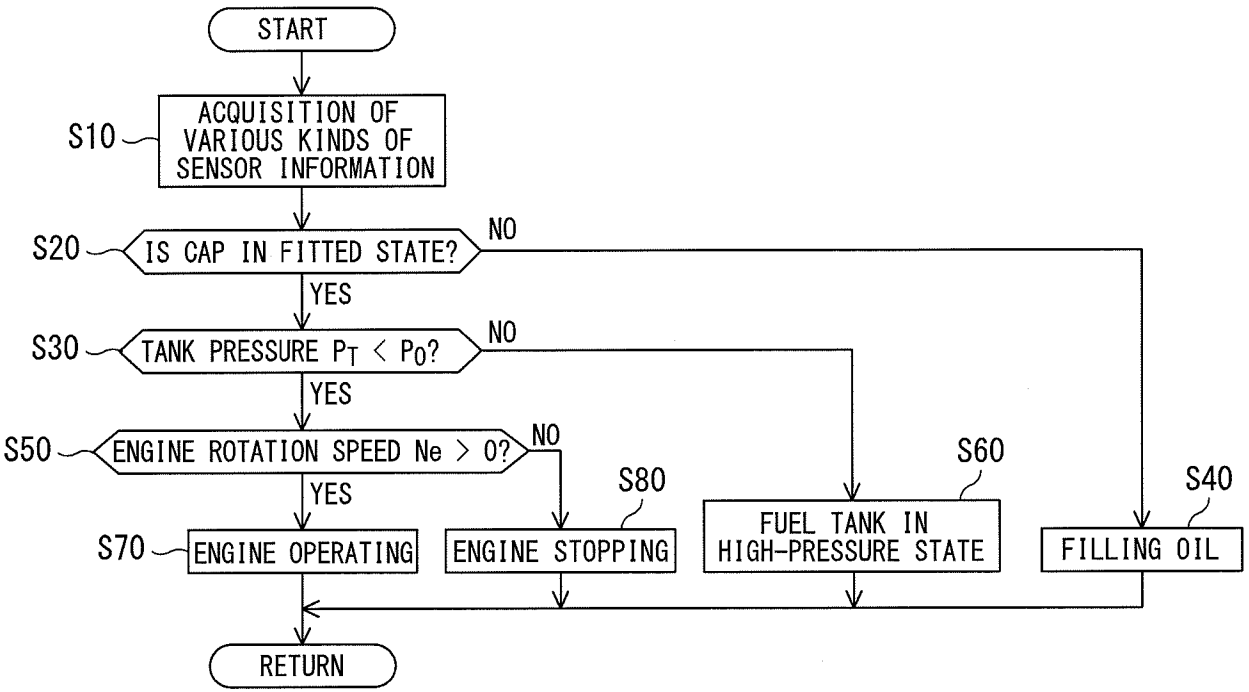
FIG. 6 is a flow chart exemplifying a decision procedure performed by the present controlling apparatus.
Figure 7:
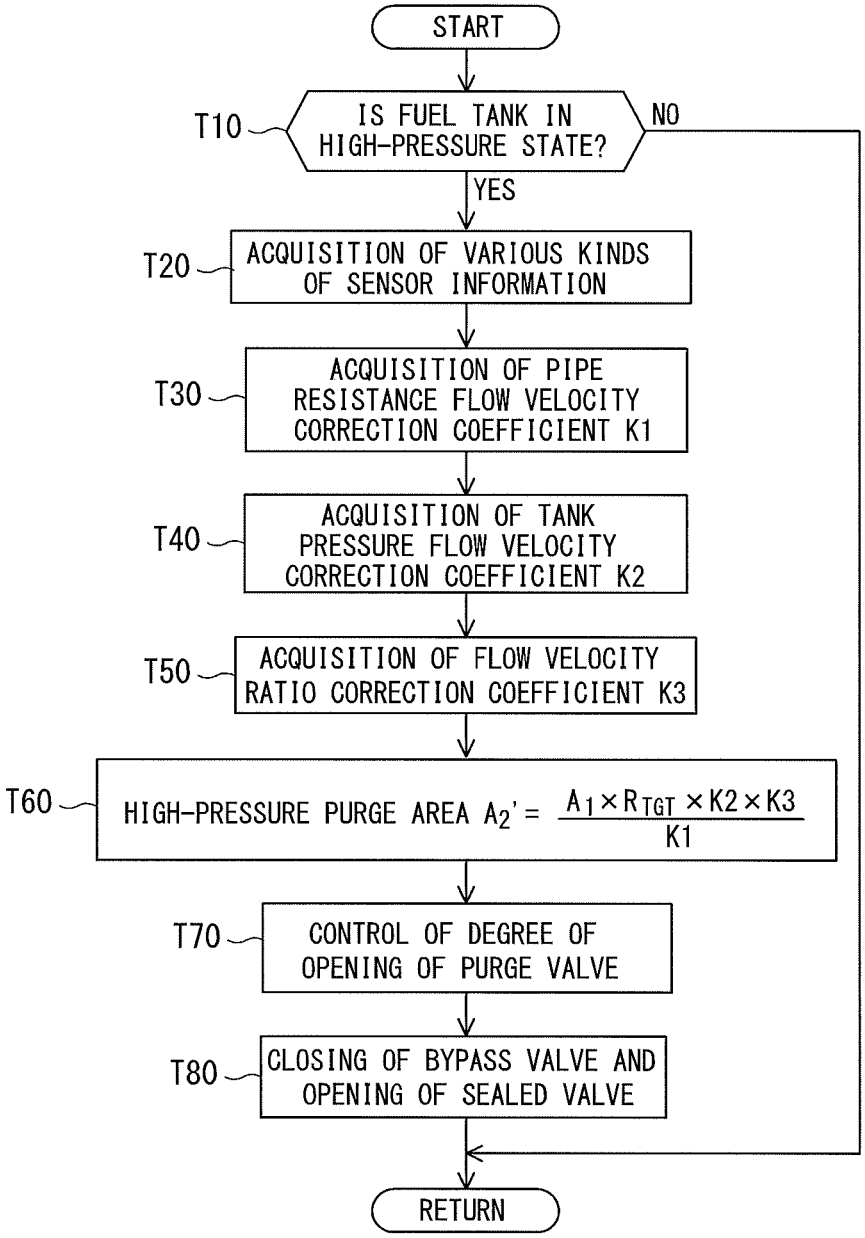
FIG. 7 is a flow chart exemplifying a controlling procedure upon high-pressure purge control by the present controlling apparatus.

FIG. 6 is a flow chart exemplifying a decision procedure performed by the decision unit 2 of the engine controlling apparatus 1, and FIG. 7 is a flow chart exemplifying a controlling procedure upon high-pressure purge control by the engine controlling apparatus 1. The procedures depicted in the flow charts operate in dependently of each other in a predetermined controlling cycle usually within a period within which energization to the engine controlling apparatus 1 is performed. Further, when the processes of the flow charts are performed, information of a result of the processes is transmitted to each other.

As depicted in FIG. 6, various kinds of sensor information including the tank pressure $P_T$, intake manifold pressure $P_{IM}$, engine rotation speed Ne and so forth are acquired at step S10. At step S20, it is decided whether or not the cap 27*b* of the fuel tank 27 is in a fitted state, and, if the cap 27*b* is in a fitted state, then the processing advances to step S30, at which it is decided whether or not the tank pressure $P_T$ is lower than the predetermined pressure $P_0$. On the other hand, if the cap 27*b* is in a removed state, then the processing advances to step S40, at which it is decided that oil filling is being performed, and then the controlling cycle ends.

If the tank pressure $P_T$ is lower than the predetermined pressure $P_0$ at step S30, then the processing advances to step S50, at which it is decided whether or not the engine rotation speed Ne is higher than zero. On the other hand, if the tank pressure $P_T$ is equal to or higher than the predetermined pressure $P_0$, then the processing advances to step S60, at which it is decided that the fuel tank 27 is in a high-pressure state, and the controlling cycle ends. If the engine rotation speed Ne is higher than zero at step S50, then the processing advances to step S70, at which it is decided that the engine 10 is operating, and the controlling cycle ends. On the other hand, if the engine rotation speed Ne is zero, then the processing advances to step S80, at which it is decided that the engine 10 is stopping, and the controlling cycle ends.

Further, as depicted in FIG. 7, it is decided at step T10 whether or not it is decided in the flow chart of FIG. 6 that the fuel tank 27 is in a high-pressure state. If the fuel tank 27 is in a high-pressure state, then processes at steps T20 to T80 are performed. However, if the fuel tank 27 is not in a high-pressure state, then the controlling cycle ends. At step T20, various kinds of sensor information are acquired. Next at step T30, the pipe resistance flow velocity correction coefficient K1 corresponding to the pressure ratio (intake manifold pressure $P_{IM}$/atmospheric pressure $P_A$) is acquired from the pipe resistance flow velocity correction coefficient map of FIG. 2.

At step T40, the tank pressure flow velocity correction coefficient K2 corresponding to the tank pressure $P_T$ is acquired from the correction coefficient map of FIG. 3. Further, at step T50, the flow velocity Vth of the intake air and the flow velocity Vp of the purge gas taking a high pressure into consideration are acquired from the flow velocity map of FIG. 4 and the flow velocity ratio correction coefficient K3 is acquired. Then, at step T60, the high-pressure purge area $A_2'$ of the purge valve 29 is calculated using the information and the coefficients acquired at steps T20 to T50.

At step T70, the opening degree control for the purge valve 29 is performed so as to establish an opening degree corresponding to the high-pressure purge area $A_2'$ calculated at the preceding step. Then, at step T80, the bypass valve 30 is controlled to a closed state and the sealed valve 33 is controlled to an open state, and then the controlling cycle ends. The processes of the flow chart of FIG. 7 are repetitively performed where the tank pressure $P_T$ of the fuel tank 27 is equal to or higher than the predetermined pressure $P_0$. It is to be noted that, since the tank pressure $P_T$ of the fuel tank 27 gradually decreases by the high-pressure purge control, the pipe resistance flow velocity correction coefficient K1, tank pressure flow velocity correction coefficient K2 and flow velocity ratio correction coefficient K3 are acquired every time (for each controlling cycle), and also the high-pressure purge area $A_2'$ varies in accordance with the decrease of the tank pressure $P_T$.

[4. Effect]

Accordingly, with the present engine controlling apparatus 1, when the opening degree $S_2$ of the purge valve 29 is calculated based on the introduction ratio (target purge ratio $R_{TGT}$) of the target purge gas, the opening degree $S_2$ of the purge valve 29 is corrected, in the high-pressure purge control, at least using the tank pressure flow velocity correction coefficient K2 corresponding to the upstream pressure of the purge valve 29. Therefore, a suitable purge gas flow rate Qp' can be secured by a simple configuration. Further, since complicated calculation is not required, the capacity of the ROM can be reduced.

Further, the opening degree $S_2$ of the purge valve 29 is corrected using the flow velocity ratio correction coefficient K3 corresponding to the ratio between the flow velocity Vth of intake air that passes the throttle valve 23 and the flow velocity Vp of the purge gas that passes the purge valve 29 so that an appropriate purge gas flow rate Qp' can be secured taking it into consideration that the upstream pressure of the purge valve 29 is higher than the atmospheric pressure $P_A$. Therefore, the calculation accuracy of the opening degree $S_2$ of the purge valve 29 in the high-pressure purge control can be enhanced.

Further, the opening degree $S_2$ of the purge valve 29 is corrected using the pipe resistance flow velocity correction coefficient K1 taking the ventilation resistance (pressure loss) until purge gas is introduced into the intake system into consideration so that the calculation accuracy for the opening degree $S_2$ of the purge valve 29 in the high-pressure purge control can be enhanced further.

Further, the correction coefficient map set such that the tank pressure flow velocity correction coefficient K2 has a proportional relationship to the upstream pressure of the purge valve 29 is provided and the calculation unit 3 can acquire the tank pressure flow velocity correction coefficient K2 using the correction coefficient map. Therefore, the opening degree $S_2$ of the purge valve 29 can be calculated with a simple configuration.

In the present embodiment, the canister 31 is dedicated for filling of oil isolated from the purge path 28 in the high-pressure purge control while recovering evaporated fuel only upon oil-filling, and the normal purge control is suitably performed while the engine 10 is operating. Therefore, the capacity of evaporated fuel capable of being absorbed by the activated carbon 31*a* of the canister 31 can be secured constantly. Consequently, for example, where the engine 10 of FIG. 1 is equipped in a hybrid electric vehicle, the necessity to operate the engine 10 in order only to desorb the evaporated fuel recovered by the canister 31 is eliminated, and improvement of fuel efficiency can be implemented.

In particular, since the hybrid electric vehicle frequently travels only with a motor while the engine 10 is kept stopped, the opportunity is limited in which the evaporated fuel recovered by the canister 31 can be purged. Therefore, where a canister for always recovering the evaporated fuel not only upon filling of oil is provided, a case occurs in which the engine 10 is obliged to be driven only for the purge control when the absorption capacity of the canister becomes poor, and the possibility that mileage may be deteriorated is high. With the engine 10 according to the present embodiment, such a situation as just described does not occur, and therefore, improvement of fuel efficiency can be implemented as described above.

[5. Others]

While the embodiment of the present invention is described above, the present invention is not limited to the embodiment specifically described above, and variations and modifications can be made without departing from the scope of the present invention.

Figure 8A:
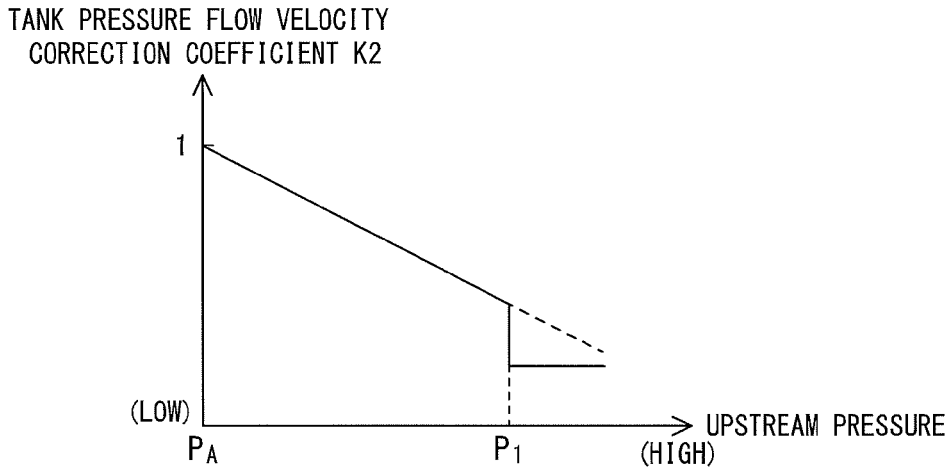
FIGS. 8(*a*) and 8(*b*) are views depicting modifications to the tank pressure flow velocity correction coefficient map of FIG. 3.
Figure 8B:
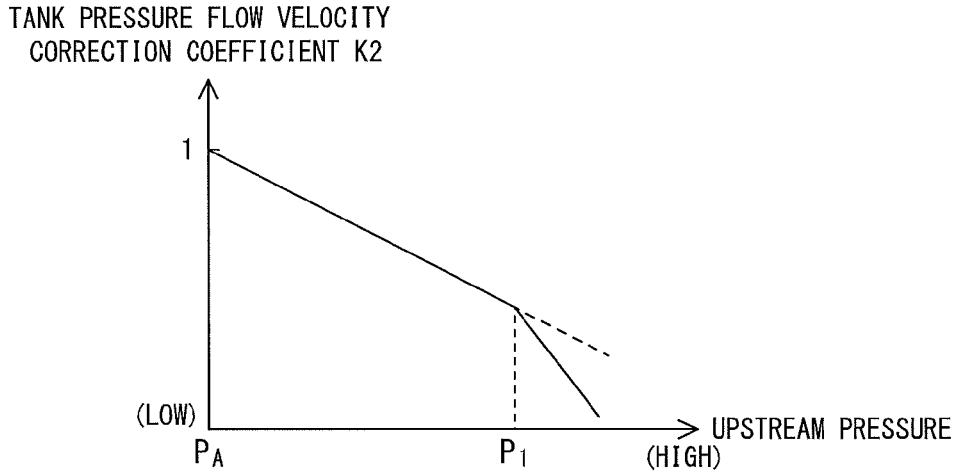

While, in the embodiment described above, it is exemplified that the correction coefficient map for acquiring the tank pressure flow velocity correction coefficient K2 is set such that the tank pressure flow velocity correction coefficient K2 linearly reduces as the upstream pressure (tank pressure $P_T$) of the purge valve 29 increases, the correction coefficient map is not limited to this. For example, such a correction coefficient map may be applied that, as indicated by a solid line in FIGS. 8(*a*) and 8(*b*), the tank pressure flow velocity correction coefficient K2 where the upstream pressure of the purge valve 29 is equal to or higher than the predetermined value $P_1$ is low in comparison with that in a case in which the upstream pressure varies with a variation ratio equal to that where the upstream pressure is lower than the predetermined value $P_1$ (graphs of a broken line in FIGS. 8(*a*) and 8(*b*)).

Further, while, in the embodiment described above, the pipe resistance flow velocity correction coefficient K1, tank pressure flow velocity correction coefficient K2 and flow velocity ratio correction coefficient K3 are used in the calculation of the high-pressure purge area $A_2'$, a configuration may be applied in which, in the high-pressure purge control, the purge area $A_2$ is corrected using at least the tank pressure flow velocity correction coefficient K2. For example, if the ventilation resistance until the purge gas is introduced into the surge tank 21 is so low that it can be ignored, then the pipe resistance flow velocity correction coefficient K1 may be omitted. Further, since the flow velocity with respect to the pressure ratio does not vary where the pressure ratio is lower than the critical pressure ratio, the flow velocity ratio correction coefficient K3 may be omitted in response to the magnitude of the pressure ratio. In other words, the purge area $A_2$ maybe corrected only with the tank pressure flow velocity correction coefficient K2 or may be corrected with the pipe resistance flow velocity correction coefficient K1 or the flow velocity ratio correction coefficient K3 in addition to the tank pressure flow velocity correction coefficient K2.

Further, the engine 10 is not limited to that depicted in FIG. 1. Further, the configuration of the fuel tank 27, purge path 28, purge valve 30, canister 31 and so forth described hereinabove is an example and is not limited to that described above. For example, the canister 31 may not be configured from a canister dedicated for oil filling or may be placed between the fuel tank 27 and the purge valve 29 without through the bypass valve 30. Further, the purge valve 29, bypass valve 30 and sealed valve 33 may be individually configured from a valve other than a needle valve.

REFERENCE SIGNS LIST

1 engine controlling apparatus
2 decision unit
3 calculation unit
4 controlling unit
10 engine
20 intake manifold
21 surge tank
23 throttle valve
24 intake path
27 fuel tank
28 purge path
29 purge valve
30 bypass valve
31 canister
33 sealed valve
36 tank pressure sensor
39 intake manifold pressure sensor The invention thus described, it will be obvious that the same may be varied in many ways. Such variations are not to be regarded as a departure from the spirit and scope of the invention, and all such modifications as would be obvious to one skilled in the art are intended to be included within the scope of the following claims.

The invention claimed is:

1. A controlling apparatus for an engine including a purge path connected to a sealing-type fuel tank and an intake system of an engine and configured to allow purge gas containing evaporated fuel from the fuel tank to flow therethrough and a purge valve placed in the purge path and configured to adjust a flow rate of the purge gas, comprising:

a calculation unit that calculates a degree of opening of the purge valve based on a target introduction ratio of the purge gas; and a controlling unit that controls the purge valve so as to establish the degree of opening calculated by the calculation unit; wherein the calculation unit corrects, in high-pressure purge performed when a pressure in the fuel tank increases exceeding a predetermined pressure, the degree of opening at least using a tank pressure flow velocity correction coefficient that reduces as an upstream pressure of the purge valve increases.

2. The controlling apparatus for an engine according to claim 1, wherein the calculation unit corrects, in the high-pressure purge, the degree of opening using a flow velocity ratio correction coefficient corresponding to a ratio between a flow velocity of intake air that passes a throttle valve of the intake system and a flow velocity of the purge gas that passes the purge valve.

3. The controlling apparatus for an engine according to claim 1, wherein the calculation unit corrects, in the high-pressure purge, the degree of opening using a pipe resistance flow velocity correction coefficient taking a ventilation resistance until the purge gas is introduced into the intake system into consideration.

4. The controlling apparatus for an engine according to claim 2, wherein the calculation unit corrects, in the high-pressure purge, the degree of opening using a pipe resistance flow velocity correction coefficient taking a ventilation resistance until the purge gas is introduced into the intake system into consideration.

5. The controlling apparatus for an engine according to claim 1, further comprising:

a correction coefficient map set such that the tank pressure flow velocity correction coefficient has a proportional relationship to the upstream pressure of the purge valve; wherein the calculation unit applies the upstream pressure to the correction coefficient map to acquire the tank pressure flow velocity correction coefficient.

6. The controlling apparatus for an engine according to claim 2, further comprising:

a correction coefficient map set such that the tank pressure flow velocity correction coefficient has a proportional relationship to the upstream pressure of the purge valve; wherein the calculation unit applies the upstream pressure to the correction coefficient map to acquire the tank pressure flow velocity correction coefficient.

7. The controlling apparatus for an engine according to claim 3, further comprising:

a correction coefficient map set such that the tank pressure flow velocity correction coefficient has a proportional relationship to the upstream pressure of the purge valve; wherein the calculation unit applies the upstream pressure to the correction coefficient map to acquire the tank pressure flow velocity correction coefficient.

8. The controlling apparatus for an engine according to claim 4, further comprising:

a correction coefficient map set such that the tank pressure flow velocity correction coefficient has a proportional relationship to the upstream pressure of the purge valve; wherein the calculation unit applies the upstream pressure to the correction coefficient map to acquire the tank pressure flow velocity correction coefficient.

9. A controlling apparatus for an engine including a purge path connected to a sealing-type fuel tank and an intake system of an engine and configured to allow purge gas containing evaporated fuel from the fuel tank to flow therethrough, a purge valve placed on the purge path and configured to adjust a flow rate of the purge gas, and a bypass valve placed on the purge path between the fuel tank and the purge valve and configured to change a communicated state with a canister for temporarily recovering the evaporated fuel and the purge path, comprising:

a calculation unit that calculates a degree of opening of the purge valve based on a target introduction ratio of the purge gas; and a controlling unit that controls the purge valve so as to establish the degree of opening calculated by the calculation unit and controls opening and closing state of the bypass valve; wherein the calculation unit corrects, in high-pressure purge performed when a pressure in the fuel tank increases exceeding a predetermined pressure, the degree of opening at least using a tank pressure flow velocity correction coefficient corresponding to an upstream pressure of the purge valve.

* * * * *